United States Patent [19]

Blancato et al.

[11] Patent Number: 4,823,416

[45] Date of Patent: Apr. 25, 1989

[54] METHOD AND APPARATUS TO PREVENT CLOGGING OF SEWER LINES

[76] Inventors: Arthur J. Blancato, 128 Englewood Ave., Barnegat, N.J. 08005; Edward G. Kobylarz, 231 Dogwood La., Forked River, N.J. 08731

[21] Appl. No.: 940,591

[22] Filed: Dec. 11, 1986

[51] Int. Cl.[4] ..... E03D 11/00

[52] U.S. Cl. ..... 4/255; 4/292; 210/447; 210/454

[58] Field of Search ..... 4/255, 257, 661, 292; 210/222, 447, 454, 498, 153–155, 162, 170, 435, 445, 446, 447, 460, 462, 463; 138/89

[56] References Cited

U.S. PATENT DOCUMENTS

| | | | |
|---|---|---|---|
| 1,146,748 | 7/1915 | Bennett | 210/446 X |
| 2,424,932 | 7/1947 | Juhasz | 210/445 X |
| 2,552,744 | 5/1951 | Smith | 210/164 |
| 2,576,640 | 11/1951 | Ramsey | 4/255 |
| 2,627,610 | 2/1953 | Hirshstein | 4/255 |
| 2,733,816 | 2/1956 | Griffith | 210/162 X |
| 2,788,128 | 4/1957 | Heine | 210/446 X |
| 3,040,898 | 6/1962 | Simmons | 210/447 X |
| 3,735,874 | 5/1973 | Steinman | 210/447 X |
| 3,904,523 | 9/1975 | Sierzega | 210/79 |
| 4,301,554 | 11/1981 | Wojcicki | 4/206 |
| 4,539,718 | 9/1985 | Haer | 4/292 |

FOREIGN PATENT DOCUMENTS

| | | | |
|---|---|---|---|
| 269463 | 1/1914 | Fed. Rep. of Germany | 4/255 |
| 82268 | 12/1934 | Sweden | 210/454 |

*Primary Examiner*—Charles E. Phillips
*Attorney, Agent, or Firm*—Michael B. Einschlag

[57] ABSTRACT

Apparatus and method for isolating and blocking articles flushed down toilets before they can get into and jam a main sewer line utilizes a threaded rod having a head for rotation thereof disposed on one end, a nut threaded onto the rod, a flat washer disposed next to the nut on the opposite side therefrom from the head, and a rubber washer disposed next to the flat washer on the opposite side therefrom from the nut. In a preferred embodiment, the rod is threaded into a threaded hole in a cleanout plug adjacent a toilet to be isolated and the nut tightens against the cleanout plug to compress the rubber washer to seal in sewer gases and fluids.

19 Claims, 3 Drawing Sheets

METHOD AND APPARATUS TO PREVENT CLOGGING OF SEWER LINES

TECHNICAL FIELD OF THE INVENTION

The present invention relates to method and apparatus for preventing clogging of sewer lines and, in particular, to apparatus for isolating and blocking miscellaneous foreign articles flushed down toilets in institutions such as prisons to prevent clogging of sewer lines.

BACKGROUND OF THE INVENTION

Institutions such as jails, juvenile shelters, and correctional facilities provide excessive idle time for inmates. Thus, either to amuse themselves or to cause as much mischief as possible, inmates flush all manner of foreign articles down toilets. These articles comprise an astonishing variety of foreign articles, such as: sheets, towels, socks, underwear, milk cartons, paper cups, plastic bags, shoes, apples, oranges, cardboard, foil and so forth. Eventually such articles flow down a sewer line to jam and clog the main sewer line. This causes overflows and finally major leaks in the sewer system. As a result, building structures are damaged. In addition, these jams are extremely annoying because they require an enormous amount of manpower to detect and clear.

As a result, there is a need for an apparatus that isolates, blocks and collects foreign articles flushed down a toilet before they reach the main sewer. Further, there is a need for such apparatus that enables the blocked articles to be easily removed from the point of blockage. Such an apparatus would be useful, as described above, in institutions such as jails, and also in homes, apartment houses, townhouses and condominiums.

SUMMARY OF THE INVENTION

The present invention solves the above-described problems and provides a method and apparatus for advantageously isolating and blocking articles flushed down toilets before they can get into and jam the main sewer line. In operation, the inventive apparatus prevents towels, sheets, blankets, paper cups, clothing, food articles such as apples and oranges, and so forth from being trapped in a main sewer line and clogging same.

An embodiment of the present invention comprises a threaded rod having a means for rotating the rod affixed thereto, a nut threaded onto the rod, a washer disposed on the rod adjacent the nut on the side of the nut opposite from the rotation means, and a compressible washer disposed adjacent to the washer on the side of the washer opposite from the nut.

In operation, in the preferred embodiment, a cleanout plug is removed from a sewer line and a hole is drilled therein. The hole is tapped to threadably accept the rod. The rod is threaded into the hole to a sufficient depth that an end of the rod will extend into the sewer line without reaching the side of the line opposite the cleanout plug when the cleanout plug is installed therein. The compressible washer is then positioned on the rod to be adjacent the hole, the washer is disposed adjacent the compressible washer and the nut is tightened against the washer to compress the compressible washer against the cleanout plug. As a result, the compressible washer acts as a seal to prevent sewer gases from escaping through the hole.

In the preferred embodiment, the rod must be resistant to corrosion and is therefore preferably formed from stainless steel. We have found that a 6 inch long, $\frac{1}{4}$ inch diameter rod having $\frac{1}{4}$ - 20 threads is sufficient for most applications, for example, for use in connection with 4 inch and 5 inch sewer pipes. The rotation means is preferably a square or hex head disposed on one end of the rod for ease of adjustment of the depth of insertion of the rod into the sewer line. In an alternative embodiment the square or hex head may be replaced by a wing nut or any conventional form for attachment to a typical tightening or removal tool such as a wrench.

In the preferred embodiment the washer is a flat washer fabricated from brass or stainless steel to prevent corrosion. The washer is preferably flat to prevent friction from occurring between it and the compressible washer. This permits the nut to be screwed down to compress the compressible washer against the cleanout plug. The compressible washer is preferably fabricated from rubber because it then makes a good, positive seal against the hole in the cleanout plug when the nut is screwed down tightly. Rubber, being more compressible than leather or felt, makes a better seal and is preferable to these materials. Finally, the cleanout plug in the sewer line may be replaced with a substitute cleanout plug specifically adapted for use in the present invention. Such a substitute cleanout plug is preferably fabricated from brass to prevent corrosion.

In operation, in the preferred embodiment, a cleanout plug is removed from a sewer line and a hole is drilled and tapped therein of sufficient size to threadably accept the rod. The rod is threaded into the hole to a depth so that it extends into the sewer line without reaching the side opposite the hole. The depth is preferably $\frac{1}{3}$ to $\frac{1}{2}$ of the diameter of the sewer line to allow body waste to pass under and around the rod.

The rubber washer has a hole which is sufficiently small that the rubber washer snuggly grips the rod. The rubber washer is positioned to be adjacent the hole. The flat metal washer is positioned against the rubber washer and the nut is tightened against the flat washer to compress the rubber washer against the hole to prevent sewer gases from escaping through the hole.

In the preferred configuration, the inventive apparatus is installed in the cleanout plug which is directly in line with an inmate's toilet. Should the inmate decide to flush articles down the toilet other than normal human waste material and toilet paper, such items would be caught by the rod of the inventive apparatus and contained. When the inmate's toilet can no longer be flushed properly because of the articles flushed and caught by the rod of the inventive apparatus, the blockage has been to that toilet alone and does not flow down to the main sewer line to jam and cause clogging of a serious nature. The resulting blockage can easily be removed by unscrewing the drain plug, cleaning out the collected debris.

In addition to the above-described use of the inventive apparatus in connection with a cleanout plug in a sewer line, the inventive apparatus can also be adapted to toilet drains in those instances where a cleanout plug has not been installed. In such cases, a hole is drilled, preferably a radial hole, and tapped into the drain pipe, typically such drain pipes are cast iron or "no-hub" drain pipe. The rod of the inventive apparatus is screwed into the pipe and the hole is sealed and the rod is locked into place by exerting pressure onto the flat washer and rubber washer by tightening the nut. As a result, sewer gas and hence sewer odors are prevented from escaping. When a blockage occurs in this configuration, it is removed by manipulating a flexible, hand held, snake wire through the toilet directly adjacent the blockage.

BRIEF DESCRIPTION OF THE DRAWING

A complete understanding of the present invention may be gained by considering the following detailed description in conjunction with the accompanying drawing, in which.

To facilitate understanding, identical reference numerals are used to designate elements common to the figures.

DETAILED DESCRIPTION

Figure 1:
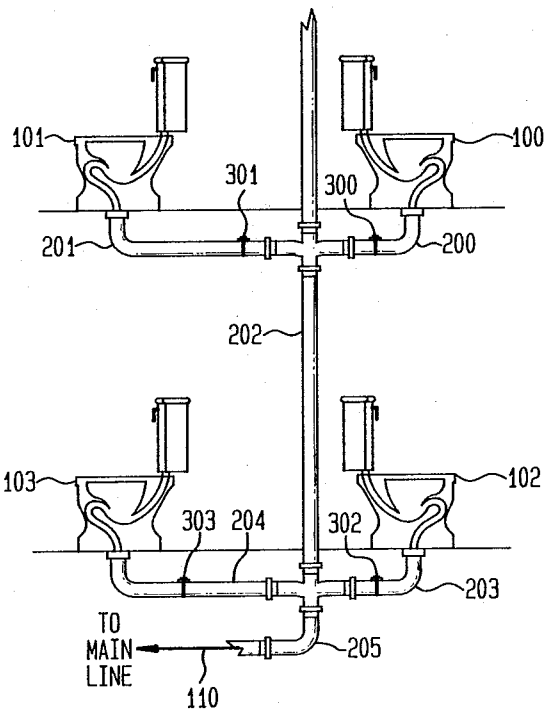
FIG. 1 shows, in pictorial form, a sewer system which uses an embodiment of the present invention.

FIG. 1 shows a sewer system which uses an embodiment of the present invention. Toilets 100–103 are connected by branch sewer pipes 200–205 to a main sewer line (not shown) indicated to be located in the direction of arrow 110. Inventive apparatus 300–303 are installed in branch sewer lines 200, 201, 203 and 204, respectively. These apparatus block articles flushed down toilets 100–103, respectively, from entering into and jamming the main sewer line or any other part of the sewer line. As shown in FIG. 1, each inventive apparatus 300–303 is installed in a cleanout plug closest to the toilet which is to be isolated.

In operation, if human waste is flushed down toilet 100, inventive apparatus 300 is adapted to let it pass through sewer pipe 200 and into sewer pipe 202 unimpeded. However, if other articles are flushed down toilet 100 they will be trapped by inventive apparatus 300. Eventually, if toilet 100 becomes clogged, or on a periodic basis, the jam may be removed from pipe 200 by removing the cleanout plug in which inventive apparatus 300 is installed. In this manner, articles flushed down the various toilets in FIG. 1 are trapped in isolated portions of the sewer pipe system and do not cause clogging and blockages in the main sewer line.

Figure 2:
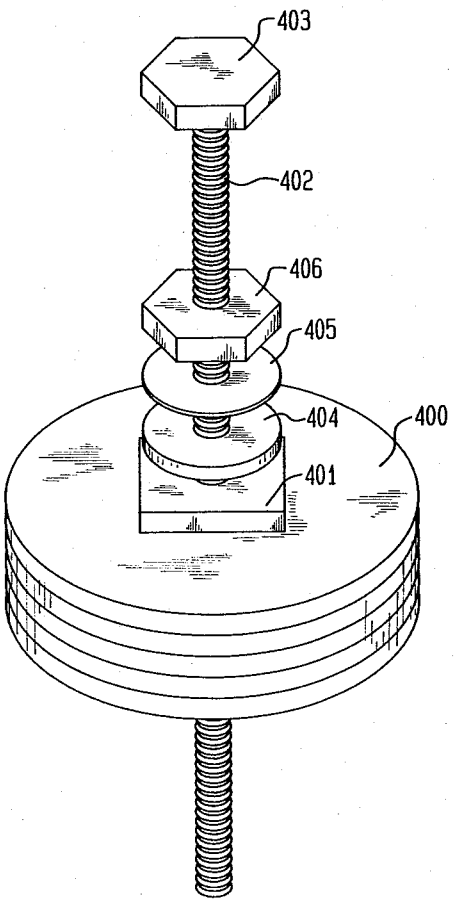
FIG. 2 shows, in pictorial form, a preferred embodiment of the present invention.

FIG. 2 shows a preferred embodiment of the present invention. Cleanout plug 400 has a square pedestal disposed in the center. This pedestal typically provides a means by which cleanout plug 400 may be gripped by a wrench to screw the cleanout plug into a sewer pipe and to remove it afterwards when access to the pipe is needed. A hole has been drilled into cleanout plug 400 through pedestal 401. In this case the hole has a ¼ inch diameter. The hole was subsequently tapped with a ¼ - 20 thread.

The inventive apparatus comprises ¼ inch diameter stainless steel threaded rod 402 having square head 402 affixed to one end thereof. Rubber washer 404, having a hole with a diameter that ensures a snug fit on threaded rod 402, is disposed on threaded rod 402 adjacent to the hole in cleanout plug 400. Flat metal washer 405 is disposed on rod 402, as shown in FIG. 2, above rubber washer 404. Finally, nut 406 threadably engages rod 402, as shown in FIG. 2, above flat metal washer 405.

In operation, rod 402 is threaded into the hole in cleanout plug 400 by twisting head 403 by hand or by using a wrench. Rod 402 is positioned so that the end opposite head 402 extends a sufficient distance from cleanout plug 400 so that when cleanout plug 400 is installed in a sewer pipe one end of rod 402 will extend into the sewer line without reaching the side of the line opposite cleanout plug 400. The end of rod 402 preferably extends a distance of ⅓ to ½ of the diameter of the sewer line from cleanout plug 400 to allow body waste to pass under and around the rod. In any event, head 403 aids in adjusting the extension of rod 402 out of cleanout plug 400 and hence the depth of extension into the sewer pipe. It should be clear to those skilled in the art that rod 402 need not be threaded over its entire length. The amount of threading is determined by the amount of extension of the rod into the sewer pipe and the amount of adjustability desired in that extension. It should also be clear that the diameter of the threaded portion and any unthreaded portion need not be the same. As a matter of fact, the portion of the rod which extends into the sewer pipe need not be circular. It may be ground into other shapes, for example, a knife edge.

After rod 402 is satisfactorily adjusted, compressible rubber washer 404 is positioned adjacent the hole in cleanout plug 400. Flat metal washer 405 is positioned adjacent rubber washer 404 and nut 406 is tightened against flat metal washer 405 to compress rubber washer 404 against cleanout plug 400. In this manner compressible rubber washer 404 acts as a seal to prevent sewer gases and fluids from escaping through the hole.

It is preferred that the inventive apparatus be resistant to corrosion. Thus, in the preferred embodiment, rod 402 is stainless steel or brass, flat metal washer 405 is stainless steel or brass, and nut 406 is stainless steel or brass. It should be also be clear to those skilled in the art that the portion of rod 402 which extends into the sewer pipe should be corrosion resistant. Thus, rod 402 may comprise a steel rod which has been coated with a corrosion resistant plastic. In this case, it is best that the diameter of the portion of the rod which extends into the sewer pipe be slightly smaller than the diameter of the hole in order to prevent the threads in the hole from cutting the plastic.

For most applications it has been found to be sufficient for rod 402 to be a 6 inch long, ¼ inch diameter rod having ¼ - 20 threads. Further, although head 403 is shown in FIG. 2 as being square, other configurations will serve just as well, for example, a hex head. Further, in an alternative embodiment the square or hex head may be replaced by a wing nut or any conventional form for attachment to a typical tightening or removal tool such as a wrench.

In the preferred embodiment washer 405 is a flat metal washer fabricated from brass or stainless steel to prevent corrosion. Washer 405 is preferably flat to prevent friction from occurring between it and compressible rubber washer 404. This permits nut 406 to be screwed down to compress compressible washer 404 to seal the hole in cleanout plug 400. Compressible washer 404 is preferably fabricated from rubber because it then makes a good, positive seal against the hole in cleanout plug 400. Rubber is more compressible than leather or felt and for that reason makes a better seal and is preferable to these materials. In an alternative embodiment, nut 406 and washer 405 may be replaced with a nut having a smooth surface and a diameter at least as large as the diameter of compressible rubber washer 404. When the wide nut is fabricated from materials such as stainless steel, the friction between the wide nut and the compressible rubber washer is minimized, and flat washer 405 may be eliminated.

In addition to the above-described use of the inventive apparatus in connection with a cleanout plug in a sewer line, the inventive apparatus can also be adapted to toilet drains in those instances where a cleanout plug has not been installed. In such cases, a hole is drilled, preferably a radial hole, and tapped into the drain pipe, typically such drain pipes are cast iron or "no-hub" drain pipe. The rod of the inventive apparatus is screwed into the pipe and the hole is sealed and the rod is locked into place by exerting pressure on the flat washer and rubber washer by tightening the nut. As a result, sewer gas and hence sewer odors are prevented from escaping. When a blockage occurs in this configuration, it is removed by manipulating a flexible, hand held, snake wire through the toilet directly adjacent the blockage (A snake is an elongated wound wire that is sufficiently flexible to be guided through the toilet drain and trap, seeking a clogged area.). If a portion of the rod which extends into the sewer pipe is not threaded, then the diameter of that portion of the rod should be slightly less than the diameter of the hole.

Clearly, those skilled in the art recognize that further embodiments of the present invention may be made without departing from its teachings. For example, the flat washer described above may also be fabricated from a plastic material and coated with a material such as Teflon (Teflon is a trademark of the Dupont Corporation) to reduce friction between it and the compressible washer. In a further embodiment, the flat washer may not be used and one may merely place an anti-friction coating either on the compressible washer or on the nut. In a still further embodiment, the flat washer, nut and compressible washer may be replaced with a nut coated with a compressible plastic material.

Figure 4:
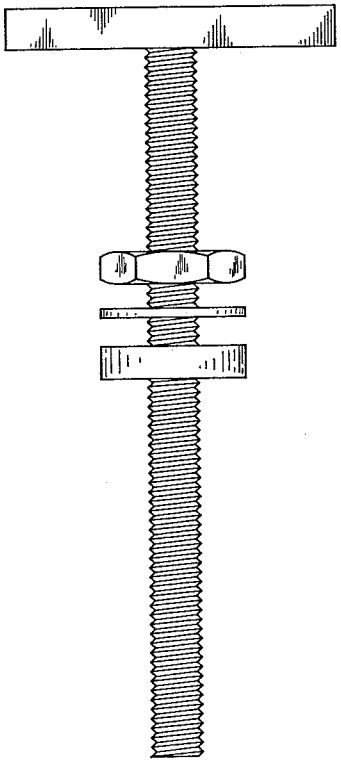
FIGS. 3–6 show, in pictorial form, further embodiments of the present invention.
Figure 3:
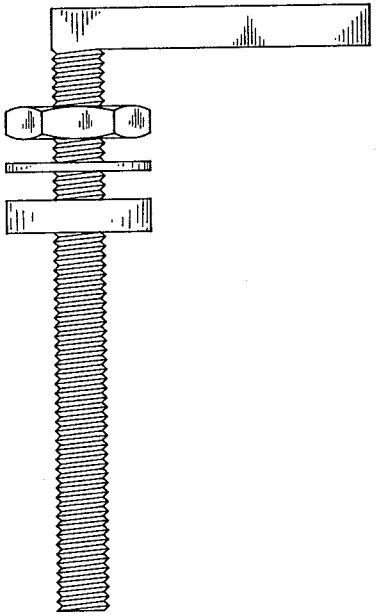

In further embodiments, the rotation means affixed to the rod may comprise a slot suitable for use with a screwdriver, in one instance, and a slot suitable for use with an allen wrench in another instance. In a still further embodiment, the rotation means may be a bend in the rod disposed at substantially a right angle thereto, as shown in FIG. 3, or it may be a T crossing member affixed to the rod at a convenient location along the rod, such as an end thereof as shown in FIG. 4.

Figure 5:
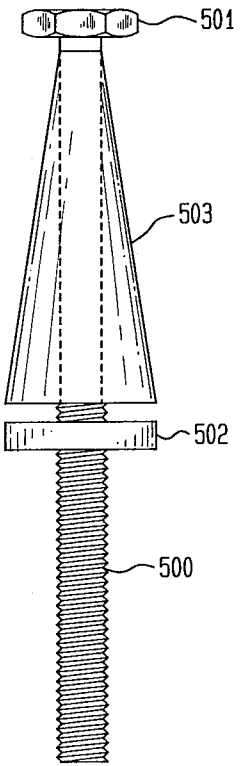

FIG. 5 shows an embodiment of the present invention comprising threaded rod 500 having hex head 501. Compressible rubber washer 502 is disposed adjacent plastic sleeve 503. In operation, rod 500 is threaded in a hole in a cleanout plug or in a sewer pipe. Rod 500 is tightened by a wrench, using hex head 501, so that sleeve 503 compresses washer 502 to seal the hole. The depth of extension of rod 500 into the sewer pipe may be adjusted by using different length sleeves.

Figure 6:
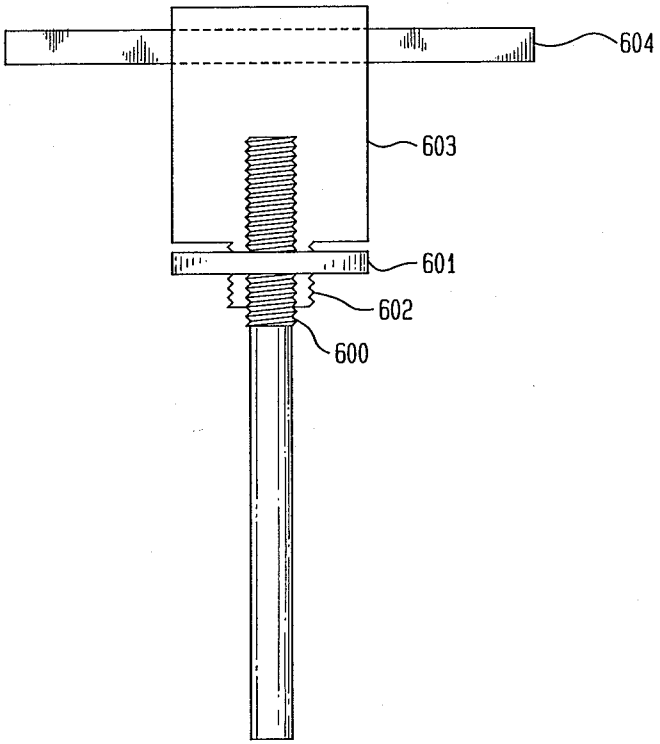

FIG. 6 shows an embodiment of the present invention comprising block 603 having threaded portion 602. Rod 600 is threaded into block 603. Rubber washer 601 is disposed on threaded portion 602 of block 603. Rod 604 is disposed in a slot in block 603. In operation, rod 600 is disposed in a hole in a cleanout plug or a hole in a sewer pipe and block 603 is threaded into the hole by means of threaded portion 602. Rubber washer 601 is compressed against the hole by rotating rod 604 to advance block 603 into the hole.

What is claimed is:

1. Apparatus for use in a threaded hole in a cleanout plug in a sewer or drain pipe or for use in a threaded hole in a sewer or drain pipe, which apparatus comprises:

a rod having a threaded portion for threadably engaging the hole so that a portion of the rod is disposed within the pipe substantially transverse to the longitudinal extent of the pipe, whereby the rod is disposed substantially transverse to the direction of the flow of fluid through the pipe, the rod being disposed within the pipe so that the length of the portion which is disposed therewithin is adjustable and the portion does not extend substantially from one side of the interior of the pipe to the other side of the interior of the pipe, and the rod further having a means affixed to the portion of the rod which is not disposed within the pipe for use in rotating the rod; and means, carried by said rod and being adjustable therealong, for sealing the hole when the rod is threadably engaged thereinto.

2. The apparatus of claim 1 wherein the means for sealing the hole comprises:

a compressible washer having a hole with a diameter of sufficient size that it snuggly fits on the rod; and means, affixed to the rod, for compressing the compressible washer against the hole.

3. The apparatus of claim 2 wherein the means for compressing further comprises:

a nut threaded on the rod between the rotation means and the compressible washer; and a washer disposed on the rod between the nut and the compressible washer, whereby the compressible washer is compressed when the nut tightens the washer against the compressible washer.

4. The apparatus of claim 3 wherein:

the rod is a stainless steel rod;

the washer is a flat washer; and the compressible washer is a rubber washer.

5. The apparatus of claim 4 wherein the flat washer is coated with Teflon.

6. The apparatus of claim 4 wherein at least one surface of the compressible washer is coated with an anti-friction coating.

7. The apparatus of claim 4 wherein the flat washer is a flat metal washer.

8. The apparatus of claim 4 wherein the rotation means comprises a slot suitable for use with a screwdriver.

9. The apparatus of claim 4 wherein the rotation means comprises a slot suitable for use with a allen wrench.

10. The apparatus of claim 4 wherein the rotation means comprises a head suitable for use with a wench.

11. The apparatus of claim 4 wherein the rotation means comprises a portion of rod disposed at substantially a right angle to the rod having the threaded portion.

12. The apparatus of claim 2 wherein the means for compressing comprises:

a nut disposed on the rod between the rotation means and the compressible washer; and an anti-friction coating disposed on the nut or on the compressible washer.

13. The apparatus of claim 12 wherein the rotation means comprises a slot suitable for use with a screwdriver.

14. The apparatus of claim 12 wherein the rotation means comprises a slot suitable for use with an allen wrench.

15. The apparatus of claim 12 wherein the rotation means comprises a head suitable for use with a wrench.

16. The apparatus of claim 12 wherein the rotation means comprises a portion of rod disposed at substantially a right angle to the rod having the threaded portion.

17. The apparatus of claim 1 wherein the means for sealing the hole comprises a nut threaded on the rod having a compressible coating on at least one surface thereof.

18. The apparatus of claim 2 wherein the means for compressing the compressible washer against the hole comprises:

a sleeve disposed adjacent the compressible washer; and means affixed to the rod for tightening the sleeve against the washer as the rod is threaded against the hole.

19. The apparatus of claim 2 wherein the means for compressing the compressible washer against the hole comprises:

a block affixed to the rod having a substantially smooth surface with an area which is at least as great as the surface of the compressible washer, which surface tightens against the compressible washer as the rod is threaded into the hole.

* * * * *